US006290578B1

(12) United States Patent
Bowman et al.

(10) Patent No.: US 6,290,578 B1
(45) Date of Patent: Sep. 18, 2001

(54) METHOD FOR CHEMICAL MECHANICAL POLISHING USING SYNERGISTIC GEOMETRIC PATTERNS

(75) Inventors: Mike L. Bowman, Chandler; Tim Dyer, Tempe; Gene Hempel; Craig M. Howard, both of Gilbert; Yushin Son, Chandler, all of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/417,941

(22) Filed: Oct. 13, 1999

(51) Int. Cl.[7] ..... B24B 5/00
(52) U.S. Cl. ..... 451/41; 451/288
(58) Field of Search ..... 451/41, 281, 225, 451/233, 237, 287, 288, 289, 290, 291, 526, 533, 544, 550, 921

(56) References Cited

U.S. PATENT DOCUMENTS

| | | | | |
|---|---|---|---|---|
| 1,422,505 | | 7/1922 | Weaver . | |
| 3,156,073 | | 11/1964 | Strasbaugh . | |
| 3,735,534 | | 5/1973 | Mayo . | |
| 3,769,762 | | 11/1973 | Mayo . | |
| 3,910,159 | * | 10/1975 | Gladwin | 451/281 X |
| 4,128,968 | * | 12/1978 | Jones | 451/270 X |
| 4,534,137 | | 8/1985 | Sarofee et al. . | |
| 5,549,511 | | 8/1996 | Cronin et al. . | |
| 5,582,534 | | 12/1996 | Shendon et al. . | |
| 5,647,792 | * | 7/1997 | Katsuoka et al. | 451/287 X |
| 5,674,109 | | 10/1997 | Kanzawa et al. . | |
| 5,759,918 | | 6/1998 | Hoshizaki et al. . | |

OTHER PUBLICATIONS

Author: Po–Yu Tsai Web page entitled: Untitled Bearing a printed date of: Wed Feb 700:49:43 CST 1996 Found at: www.erc.msstate.edu web site.

Author: Dr. Sy Meshkat Title: Very–high–speed machining gets a boost Bearing a printed date of: Feb. 1, 1999 Found at: Design News, beginning at p. 71.

* cited by examiner

*Primary Examiner*—Joseph J. Hail, III
*Assistant Examiner*—Anthony Ojini
(74) *Attorney, Agent, or Firm*—Snell & Wilmer, LLP

(57) ABSTRACT

A method for planarizing the surface of a wafer against a polishing pad includes the steps of securing the wafer in a carrier, pressing the wafer against the polishing pad, rotating both the wafer and pad, and moving the wafer across the polishing pad to create one or more geometric patterns relative to the pad. Geometric patterns employed by the present method include a 'figure eight', an elliptical pattern, and a peanut-shaped pattern. In one embodiment of the invention, both a 'figure eight' pattern and an elliptical pattern are used during a single planarizing operation. Bezier splines (curves) are used to create geometric patterns employed by the planarizing process. The use of Bezier splines requires that only two endpoints and two control points be stored in a memory device to represent the entire curve between the two endpoints, thus reducing the amount of data that has to be stored and transferred in order to operate a programmable wafer carrier in accordance with the present method.

11 Claims, 10 Drawing Sheets

METHOD FOR CHEMICAL MECHANICAL POLISHING USING SYNERGISTIC GEOMETRIC PATTERNS

TECHNICAL FIELD

The present invention relates generally to the art of planarizing workpieces such as semiconductor wafers, and more particularly, relates to an improved process whereby a wafer is moved in a certain geometric pattern or combination of patterns on a polishing pad to optimize the planarization of the wafer.

BACKGROUND OF THE INVENTION

Problem

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough.

The front face of the wafer on which integrated circuitry is to be constructed must be extremely flat in order to facilitate reliable semiconductor junctions with subsequent layers of material applied to the wafer. Also, material layers applied to the wafer while building interconnects for the integrated circuitry must also be made a uniform thickness. The removal of projections and other imperfections to create a flat planar surface, both locally and globally, and/or the removal of material to create a uniform thickness for a deposited thin film layer on a wafer are referred to as planarization. To this end, chemical mechanical planarization ("CMP") machines have been developed, and are well known in the art (sometimes referred to as chemical mechanical polishing machines), to provide controlled planarization of semiconductor wafers and layers deposited on the wafers.

A typical CMP machine generally includes one or more wafer carriers which retain, carry and control the movement of a wafer to be planarized and which press the front face of the wafer against the surface of a polishing pad. It is important that the wafer carrier is moved with respect to the polishing pad in a manner that allows all areas of the wafer to be polished uniformly.

The polishing pad is often moved at high speeds with respect to the wafer. Polishing pads are typically used on polishing platens that are rotated, as in U.S. Pat. No. 5,498,196, or orbited, as in U.S. Pat. No. 5,554,064, but can also be used in linear belt systems, as in U.S. Pat. No. 5,692,947, or in rotary drum systems as in U.S. Pat. No. 5,707,274 or 5,643,056 or on any other machine that causes relative motion between the wafer and the polishing pad.

Although polishing pads have been developed that do not require the use of an abrasive slurry, a slurry is typically introduced between the wafer and polishing pad to enhance the removal rate of material from the wafer. A common problem is that the wafer will often hydroplane on the slurry causing the wafer to tilt and make uneven contact with the polishing pad due to the relative motion of the wafer and polishing pad. This tilting causes the leading edge of the wafer to be polished at a different rate than the rest of the wafer. Wafers are thus usually rotated during the planarization process to provide more uniform polishing thereof. Although rotation of the wafer tends to average the unevenness of the planarization over the entire wafer edge, the mere rotation of the wafer is not sufficient to produce a wafer which is uniformly planar.

Another problem with existing wafer planarization methods is that the polishing pad wears faster in areas that have longer periods of contact with the wafer. A common problem is for the polishing pad to become concave due to excessive wear in areas having the greatest periods of contact with the wafer. Some of the prior art has attempted to reduce this problem by oscillating the wafer across the polishing pad, moving the wafer in a variable path, as in U.S. Pat. No. 5,549,511 or moving the wafer in a series of arcs, as in U.S. Pat. No. 5,759,918.

However, sudden changes in direction of the wafer carrier cause the carrier and attached wafer to tilt down in the direction of movement across the polishing pad. In addition, the wafer tends to tilt back and forth as it attempts to align itself to the polishing pad after each change indirection is initiated. This tilting occurs in prior art methods even though sophisticated gimbals, membranes or other means are used to keep the wafer parallel to the polishing pad.

An additional problem is presented by wafer planarization systems which move a wafer across a polishing pad in non-linear patterns. In typical prior art systems, a curve to be traced, or tracked, by the wafer carrier is broken down into small line segments which are stored in memory in the motion controller for the wafer carrier. A complex curve may have numerous line segments and each of these segments requires a large number of data points to accurately describe the particular curve in a typical numerical controller using 'G-code', which was an early industry standard. In operation, a large volume of code must be executed in a relatively short time by the numerical controller. Because the time required to execute a block of code is typically shorter than the time required to transfer and process the code, the controller is often unable to timely respond to control commands in high-speed applications.

NURBS ('Non-Uniform Rational B-Splines') has replaced G-code as an architecture for describing three-dimensional surfaces, and has become the de facto industry standard for the representation and data exchange of geometric information on parts in machine tools. NURBS is based on a generalization of non-rational B-splines and non-rational and rational Bezier curves and surfaces. However, one of the drawbacks of using NURBS is the need for extra data storage (as compared to basic Bezier curves) to define common geometrical shapes (e.g. circles). This extra storage requirement results from NURBS' use of supplementary parameters in addition to the control points. NURBS-shapes are not only defined by control points; weights, associated with each control point, are also necessary. Thus, NURBS, while providing an improvement over G-code, still requires that a significant amount of data be stored and then transferred in real-time during a planarizing operation.

Therefore, a method is needed for planarizing a wafer against a polishing pad that uses an easily generated and compactly stored geometric pattern which evenly wears the pad and evenly planarizes the wafer by minimizing wafer tilting during the polishing process.

SUMMARY OF THE INVENTION AND SOLUTION

The present invention provides a method for processing a wafer on a polishing pad which addresses and resolves the shortcomings of the prior art described above.

In accordance with the present invention, a method for planarizing the surface of a wafer against a polishing pad includes the steps of securing the wafer in a carrier, rotating both the wafer and the pad, pressing the wafer against the polishing pad, and moving the wafer across the pad to create one or more geometric patterns relative to the pad. Geometric patterns which are employed by the present method to produce advantageous results include a 'figure eight', an elliptical pattern, and a peanut-shaped pattern. In an exemplary embodiment of the present invention, both a 'figure eight' pattern and an elliptical pattern are used during a single planarizing operation.

The present invention planarizes a bare wafer or a metal layer on a wafer, and has been found to work exceptionally well for planarizing dielectric layers on a wafer. The invention may be practiced in a wide variety of systems that planarize wafers, such as a linear belt system (as illustrated in FIG. 3), an orbital system (as illustrated in FIG. 4) or a roller system (not illustrated), and is preferably performed on a rotational system (as illustrated in FIGS. 1, 2, 5–8, and 10).

Various means for moving a wafer across a polishing pad in geometric patterns are well known in the art. For example, the SSP136 CMP machine offered for sale by SpeedFam-IPEC Corporation in Chandler, Ariz., is capable of moving wafers across a rotating polishing pad in an infinite number of programmable patterns while simultaneously pressing the wafer against the polishing pad. Also, U.S. Pat. No. 5,759,918, which is incorporated herein by reference, discloses apparatus capable of programmably moving a polishing pad in relation to a wafer in various patterns.

The method of the present invention is operative with existing CMP machines to provide extremely even polishing (planarization) by causing a wafer to trace geometric patterns. These patterns eliminate sudden changes in direction of the wafer carrier that cause the carrier and attached wafer to tilt while moving across the polishing pad, thereby significantly increasing the uniformity of the polishing operation.

In one embodiment of the present invention, the edge of a wafer being polished may be allowed to overhang the edge of the polishing pad while tracing part of a 'figure 8' pattern, an elliptical pattern or a peanut-shaped pattern. In another embodiment the entire wafer remains in contact with the polishing pad while tracing any of these patterns. The method of the present invention also greatly simplifies the creation and storage of geometric curve data by employing Bezier splines (curves) to represent the particular geometric patterns to be used in the planarizing process. Two endpoints and two control points are the only data that need to be stored in memory to represent the entire curve between the two endpoints. The small amount of data generated for each spline enables the data to be rapidly transferred between a Bezier spline editing computer and a programmable wafer carrier. Furthermore, since only a small amount of space is required to store the polishing pattern coordinates, many different polishing patterns can be stored on a single portable storage medium such as a flexible disk.

These and other aspects of the present invention are described in detail in the following description, claims and appended drawings.

BRIEF DESCRIPTION OF THE DRAWING

The present invention is described in conjunction with the appended drawing figures, wherein like numerals denote like elements, and.

DETAILED DESCRIPTION

Figure 1:
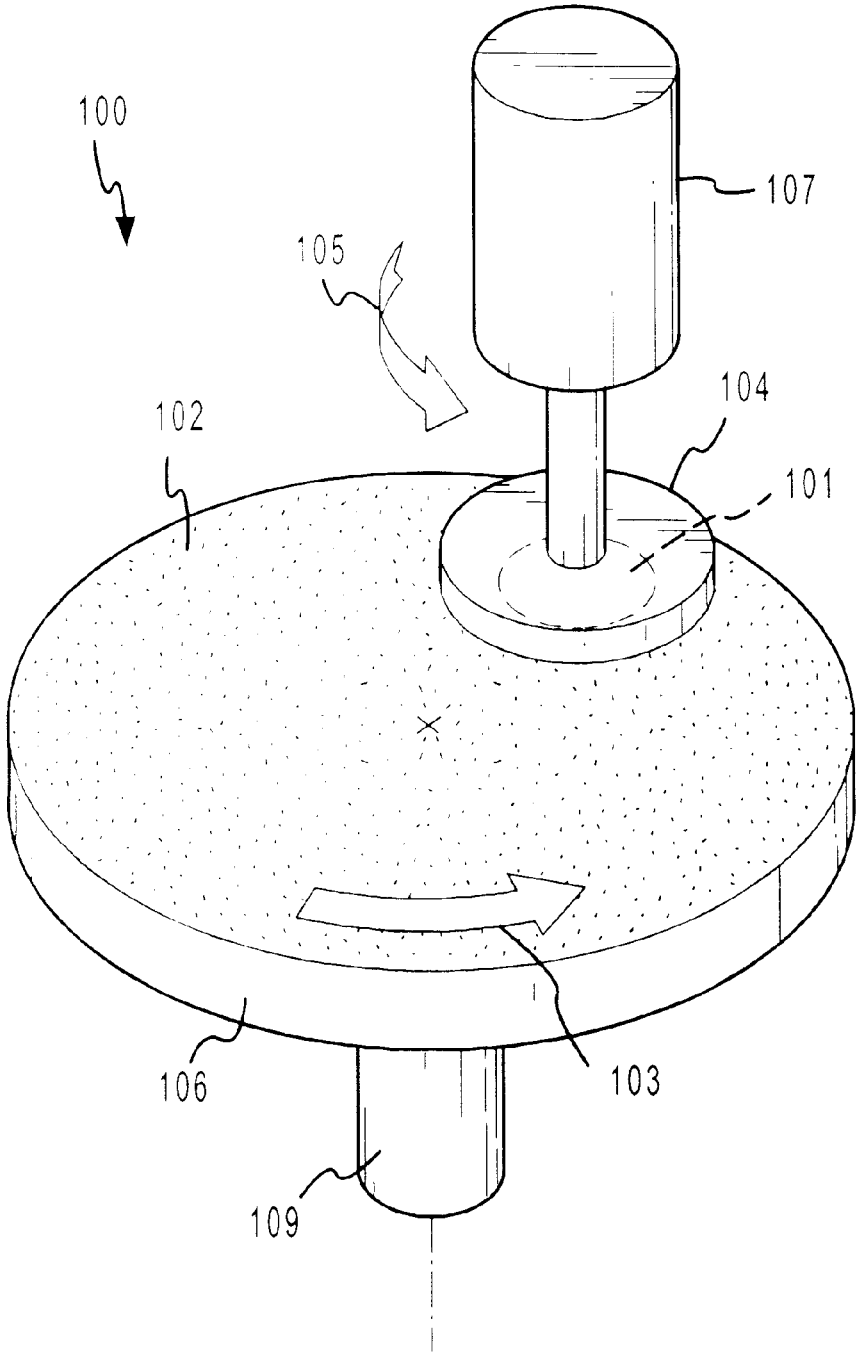
PRIOR ART FIG.1
FIG. 1 is a simplified view of a prior art rotational CMP machine.

FIG. 1 is a simplified view of a prior art rotational wafer carrier 100 capable of practicing the current invention. The planarization system used to perform the method of the present invention includes a wafer carrier 104 for pressing a wafer 101 against a polishing pad 102 while moving the wafer in relation to the polishing pad in one or more geometric patterns, described in detail below. As shown in FIG. 1, wafer carrier 104 is rotationally driven by motor 107 about a vertical axis, as shown by arrow 105, while polishing platen 106 is rotationally driven by motor 109 about a vertical axis, as shown by arrow 103. The rotational rate of platen 106 is typically between 30 and 90 revolutions per minute (rpm) and preferably between 50 and 60 rpm. Platen 106 is preferably at least four times the diameter of the wafer 101 being planarized. Platen 106 is made of a rigid planar material covered by a polishing pad 102.

Polishing pads 102 can be formed of various materials, as is known in the art, and are available commercially. Typically, polishing pad 102 is a blown polyurethane, such as the IC and GS series of polishing pads available from Rodel Products Corporation (Rodel) in Scottsdale, Ariz. Preferably, polishing pad 102 is a Rodel model number IC1000-SIV B. The polishing pad 102 should be conditioned, as is known in the art, between each planarization process.

Slurry may be introduced between the wafer 101 and the polishing pad 102 to enhance the polishing process, and preferably 700 milliliters per minute of commercially available Cabot SS12 slurry is dispensed during the planarization process. The selection of the slurry and amount used is determined by the polishing pad characteristics and the material being removed from the wafer 101.

Wafer 101 is held in wafer carrier 104 substantially parallel to the polishing pad 102 and is pressed against the polishing pad 102 with a force of preferably between 5 and 9 pounds per square inch. The carrier 104 is rotated by rotational motor 107, as shown by arrow 105, and is preferably rotated in the same direction as the polishing pad 102. Wafer carrier 104 is preferably rotated 10% faster than the polishing pad rotational speed. In one exemplary embodiment, carrier 104 rotates at 55 to 66 rpm while polishing pad 102 rotates at 50 to 60 rpm during a polishing operation.

The length of time of the planarization process depends on the amount of material that is to be removed from the bottom surface of the wafer 101. Factors such as the pressure between the wafer 101 and the polishing pad 102, the type of polishing pad 102 and slurry used, and the speed of the polishing pad 102 relative to the wafer 101, all affect the removal rate and thus the amount of time needed to planarize the wafer.

During the planarization process, wafer 101 is moved across polishing pad 102 in a figure eight pattern and an elliptical pattern, or, alternatively, in a peanut-shaped pattern, to wear the pad 102 at an even rate. The size of the pattern is selected such that as much as possible of the polishing pad 102 surface is used. The pattern may even be so large that part of the wafer 101 overhangs the polishing pad 102 during the wafer's path across the polishing pad 102 (as shown in FIG. 6B, described below). Overhanging the wafer 101 in relation to the polishing pad 102 improves the even wear of the edges of the pad 102. The size of a particular polishing pattern is preferably such that wafer 101 comes in contact with at least 70% of the polishing pad 102 during the course of a polishing operation. In addition, the amount of the wafer surface that is allowed to overhang the polishing pad and the length of time the during which the wafer is overhanging can be controlled to adjust the process that might otherwise polish the edge of the wafer more rapidly than the center area thereof.

A large pattern will assist in the even wear of the polishing pad thereby allowing the wafer to always be in contact with a substantially planar polishing pad. In addition, larger patterns also have more gradual curvatures that effectively slow the rate of change in direction or velocity of the wafer during the planarization process, thereby minimizing the tilting of the carrier.

Alternative CMP Machines

Although the present invention finds great utility when employed by rotational CMP machines, the method of the present invention may be practiced by other types of CMP apparatus known in the art, such as linear belt systems or orbital systems.

Figure 3:
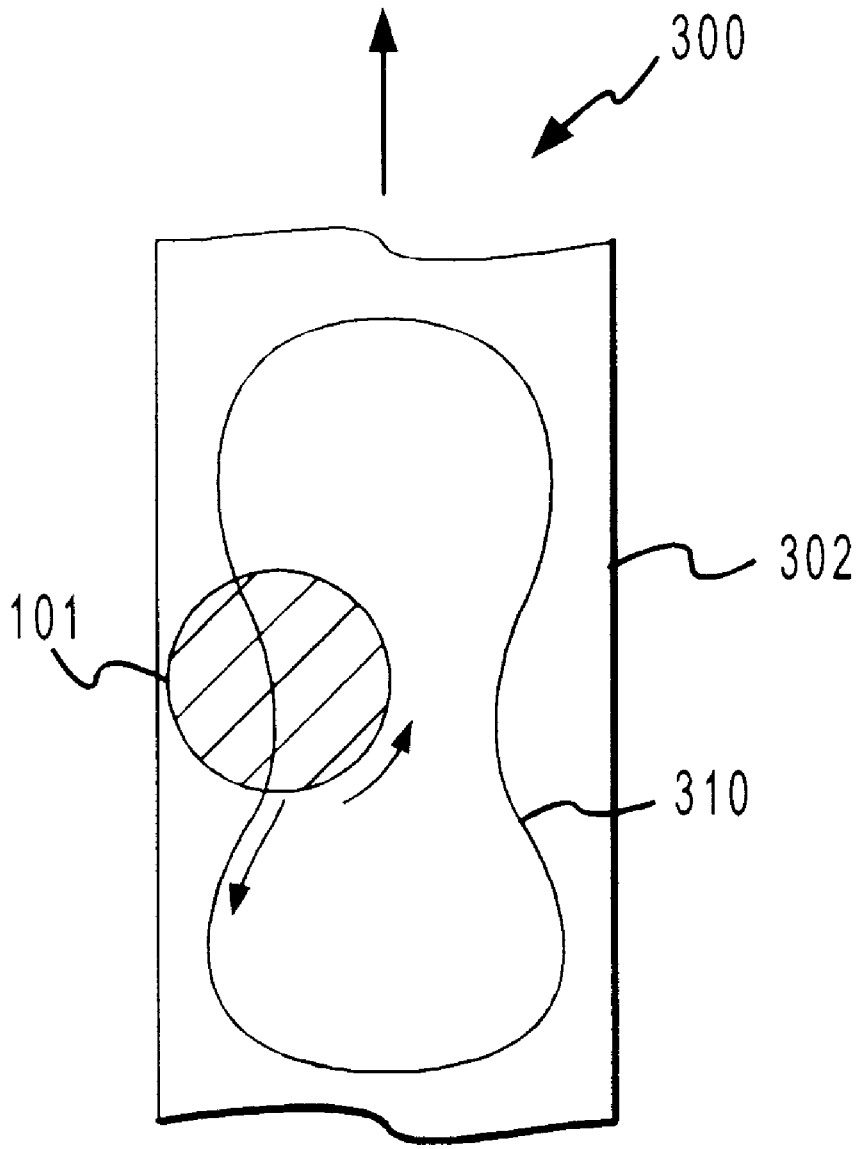
FIG. 3 illustrates a linear belt system employing a peanut-shaped polishing pattern.

FIG. 3 illustrates a linear belt CMP system 300 employing a peanut-shaped polishing pattern 310. In operation, belt 302 moves linearly past wafer 101, which is rotated as it is moved to trace a peanut-shaped pattern 310 relative to an initial position of the wafer. A 'figure eight' pattern or an elliptical pattern could also be traced by the linear belt system 300 to improve the performance of the planarization process relative to that achieved with a static wafer/pad position.

Figure 4:
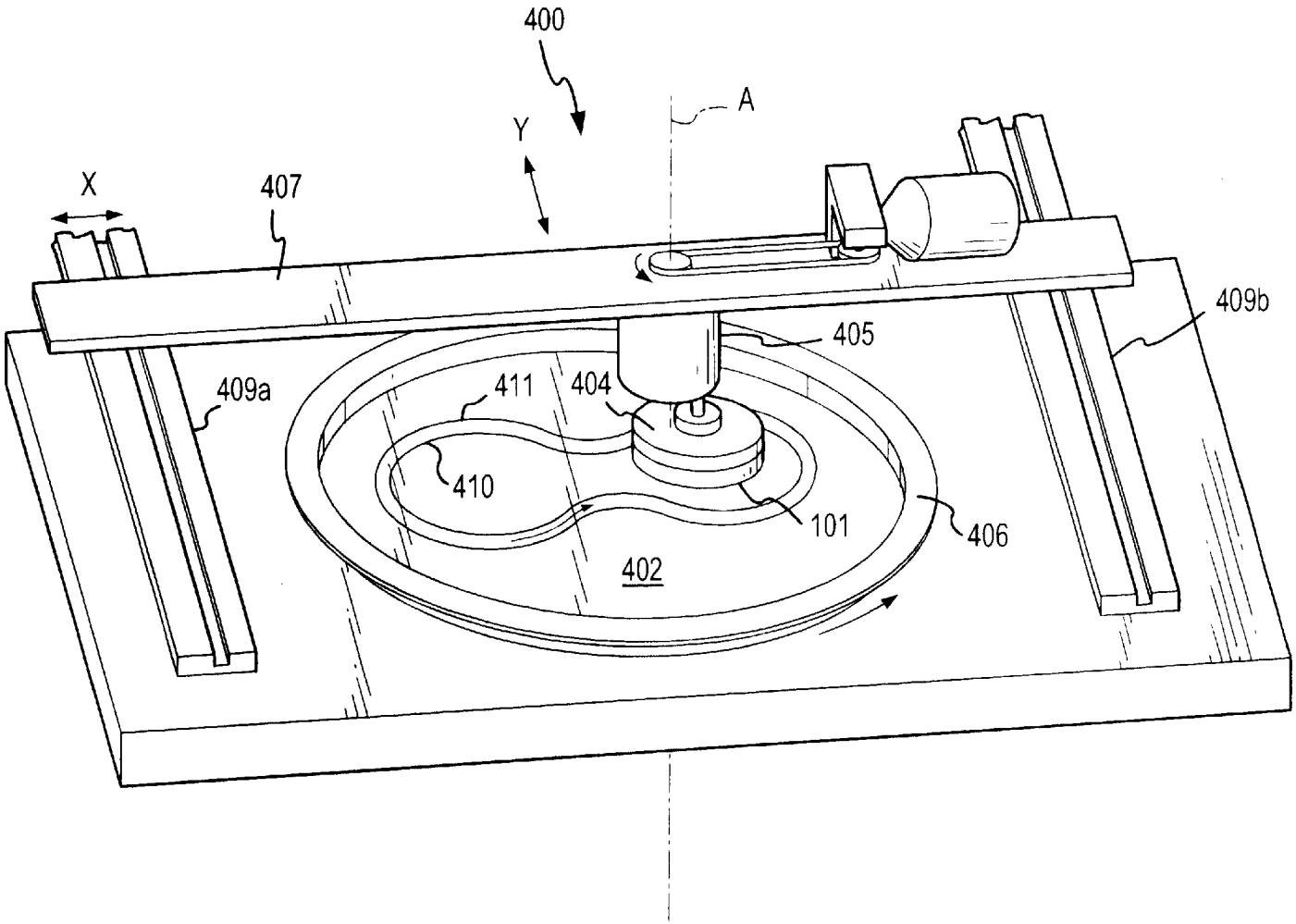
FIG. 4 illustrates an orbital system tracing a peanut-shaped polishing pattern.

FIG. 4 illustrates an orbital CMP system 400 tracing a peanut-shaped polishing pattern 410/411. Wafer 101 is affixed to carrier 404 which is caused to orbit about axis A by mechanism 405. The position of carrier 404 and wafer 101 are controlled by a programmable non-linear carrier mechanism (not shown) known in the art. Software control is employed to define an x-y coordinate wafer carrier path over the polishing pad 402, and is explained in detail below. Member 407 moves in the Y direction along rails 409*a* and 409*b*, as the position of the movable carrier (including member 407 and rails 409) relative to plate 406 and pad 402 is controlled so that a peanut shaped pattern 410/411 is traced. Patterns 410 and 411 represent the inner and outer paths, respectively, traced by the center of wafer 101 as it orbits about axis A. Rails 409 are shown for the purpose of illustration, and a suitable carrier displacement mechanism may employ other means for moving carrier head/wafer 404/101.

Geometric Polishing Patterns

The method of the present invention functions advantageously with a number of geometric polishing patterns including an ellipse, a 'figure eight' pattern, and a peanut-shaped pattern. Process conditions for wafer planarization using any of these geometric polishing patterns on a Speedfam SSP 136 planarizing machine include the following general parameters (with reference to FIG. 1). The rotational speed of the wafer carrier 104 is preferably greater than 40 RPM, with a carrier velocity in excess of 1 meter per minute; the platen/polishing pad 106/102 rotational speed should be greater than 30 RPM; and the downforce exerted by wafer 101 on pad 102 should be approximately 160 Kg.

Peanut-Shaped Pattern

Figure 5:
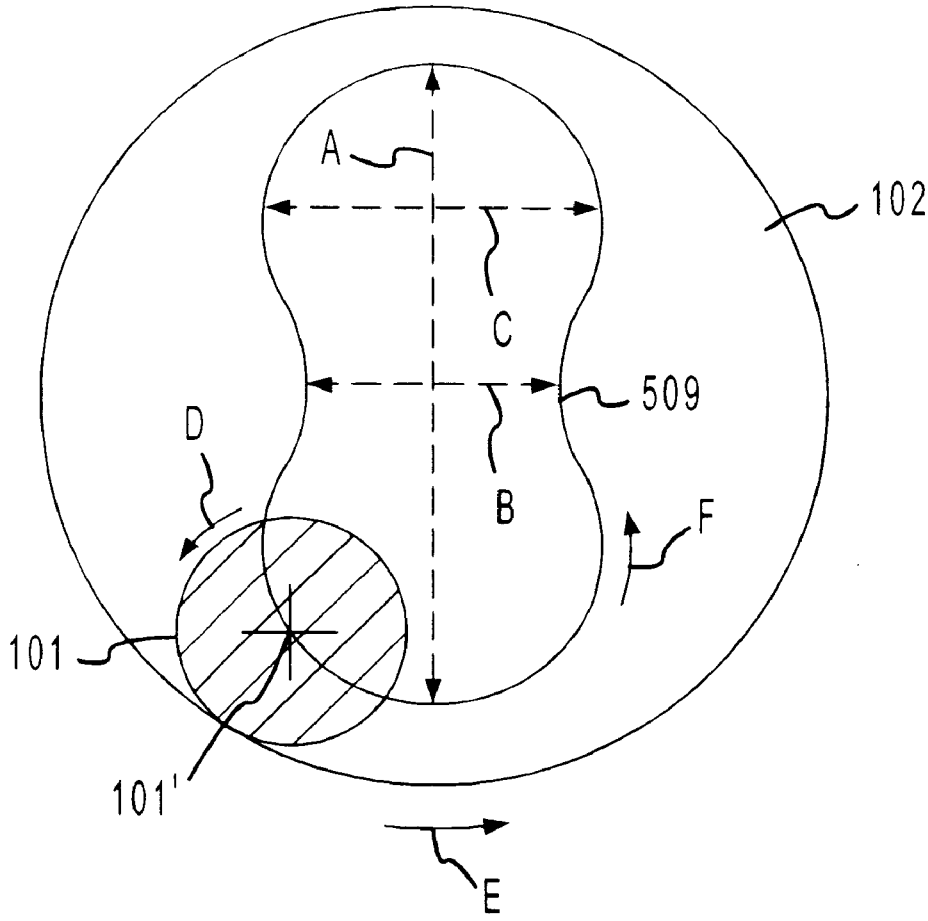
FIG. 5 is a top view of a polishing pad in a rotational CMP machine showing a peanut-shaped polishing pattern.

FIG. 5 is a top view of a polishing pad 102 in a rotational CMP machine, showing a peanut-shaped polishing pattern 509 traced by the center of wafer 101. The peanut shape is derived from a time-averaged plot of an ellipse and a 'figure eight', where both patterns have approximately the same length and the same maximum width. As illustrated in FIG. 5, wafer 101 is moved in a peanut-shaped pattern 509 relative to polishing pad 102 during the planarization process. The length, or major axis, 'A' of the peanut pattern 509 is preferably twice the width of the widest part 'C' of either lobe; and the width of the 'waist' 'B' of peanut 509 is preferably between 40 and 60 percent of lobe width 'C'. The same relative dimensions of widths 'B' and 'C' are preferred for each of the peanut-shaped patterns employed by the present method. In all of the polishing patterns employed by the method of the present invention, wafer 101 and pad 102 both preferably rotate in the same direction, as shown by arrows 'D' and 'E'. The direction of travel 'F' of the center 101' of the wafer is in the same direction, i.e., either clockwise or counter-clockwise, as the rotational direction 'E' of the pad.

Figure 6A:
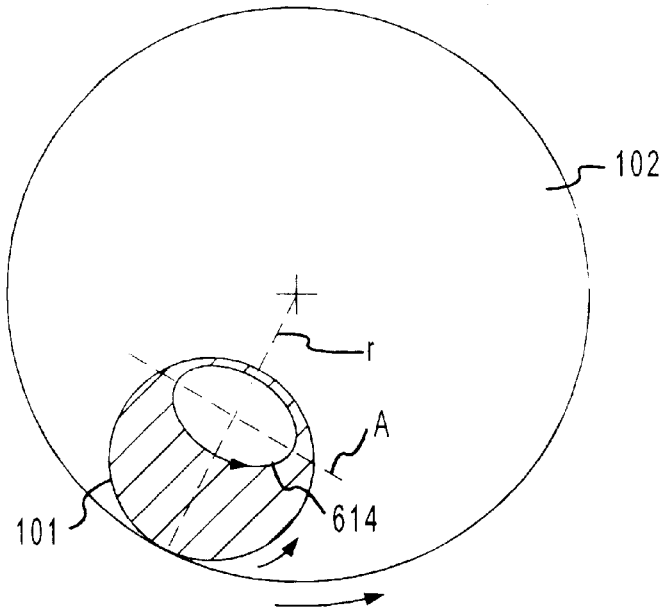
FIG. 6A is a top view of a polishing pad showing an elliptical polishing pattern.
Figure 6B:
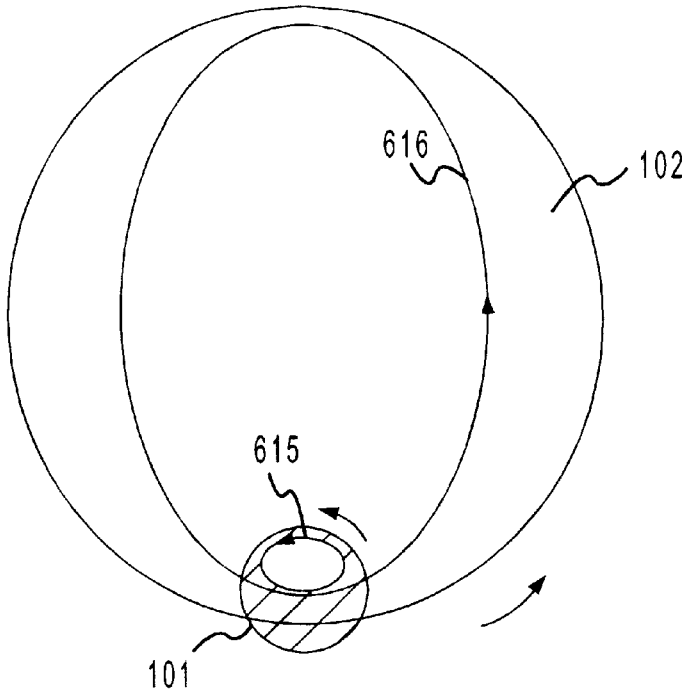
FIG. 6B is a top view of a polishing pad showing an elliptical polishing pattern where the wafer overhangs the polishing pad.

FIG. 6A is a top view of a polishing pad 102 showing an elliptical polishing pattern 614 traced by the center of wafer 101. As shown in FIG. 6A, wafer 101 and polishing pad 102 are both rotated in the same direction (e.g., counterclockwise in FIG. 6A) as the direction travel of the wafer relative to the pad. As shown in FIG. 6A, the long axis 'A' of elliptical pattern 614 is preferably substantially perpendicular to a radial line 'r' drawn from the center of polishing pad 102 through the center of axis 'A'. Axis 'A' is preferably offset from the center of pad 102 by a distance which maximizes the area of the pad which is swept by wafer 101 during a polishing (or planarizing) operation, while keeping the greater part of the wafer on the pad at all times. The wafer may in fact overhang the edge of the pad, as described below.

FIG. 6B is a top view of a polishing pad 102 showing an elliptical polishing pattern 616 traced by the center of wafer 101 wherein the wafer overhangs the edge of the polishing pad. As shown in FIG. 6B, a part of wafer 101 extends beyond the edge of pad 102 for at least part of the path 616 traced by the wafer.

Figure 7:
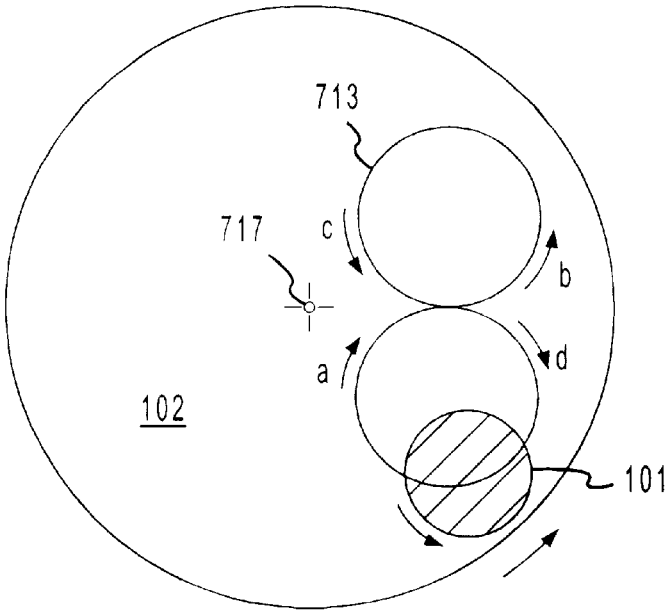
FIG. 7 is a top view of a polishing pad showing a 'figure eight' polishing pattern.

FIG. 7 is a top view of a polishing pad 102 showing a 'figure eight' polishing pattern 713 traced by the center of wafer 101. As shown in FIG. 7, wafer 101 traces a 'figure eight' path, repetitively following arrows a, b, c, and d in sequence. Wafer 101 may alternatively trace the same path in a reverse direction, i.e., by travelling in the opposite direction indicated by arrows a, d, c, and b. The 'figure eight' pattern 713 shown in FIG. 7 is offset with respect to the center of the pad 102 so that wafer 101 does not obstruct slurry feed aperture 717 (in CMP machines having a center slurry feed) at any point along the wafer's travel path when tracing the 'figure eight' pattern 713. A 'figure eight' pattern may also be traced so that one of the lobes of the 'figure eight' circumscribes the center of the polishing pad 102, as shown in FIG. 8.

Synergism of Ellipse and Figure Eight Geometric Patterns

Figure 8:
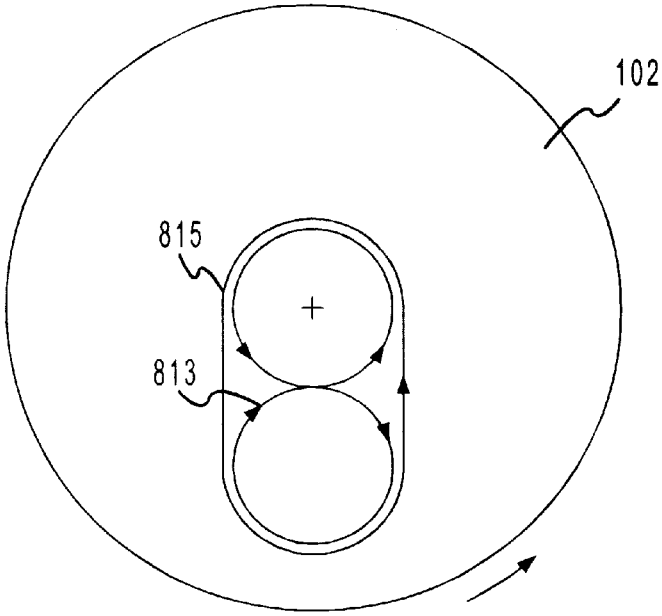
FIG. 8 is a top view of a polishing pad showing an elliptical polishing pattern superimposed on a 'figure eight' pattern.

FIG. 8 is a top view of a polishing pad 102 showing a 'figure eight' pattern 813 superimposed on an elliptical polishing pattern 815. In the embodiment illustrated in FIG. 8, wafer 101 is first moved in an elliptical pattern 815 relative to the polishing pad 102 during the first step of the planarization process.

As shown in FIG. 8, wafer 101 and polishing pad 102 are both rotated in the same direction (e.g., counterclockwise in FIG. 8) as the direction travel of the wafer relative to the pad. The length of ellipse 815 is preferably approximately twice that of its width, and, for an eight inch diameter wafer 101 on a polishing pad 102 having a diameter of 36 inches, the dimensions of ellipse 815 are preferably 120 mm and 60 mm.

During the second step of the planarization process, wafer 101 is moved in a 'figure eight' pattern 813 relative to the polishing pad 102. As illustrated in FIG. 8, the 'figure eight' pattern 813 is essentially superimposed on the ellipse 815. The length of the 'figure eight' 813 is preferably approximately twice that of its width, and, for an eight inch wafer 101 on a polishing pad 102 having a diameter of 36 inches, the length and width of the 'figure eight' are preferably 120 mm and 60 mm, respectively. The optimum shape for the 'figure eight' 813 is a pattern wherein each lobe of the 'figure eight' is essentially circular. The ellipse 815 and 'figure eight' patterns 813 traced during the planarization process may be completed in any order. However, the length of time planarizing the wafer 101 using the elliptical pattern 815 should be ±20% of the time planarizing the wafer 101 using the 'figure eight' pattern 813. Preferably, the same amount of time should be used planarizing the wafer with the elliptical pattern 815 as planarizing the wafer with the 'figure eight' pattern 813.

Figure 10A:
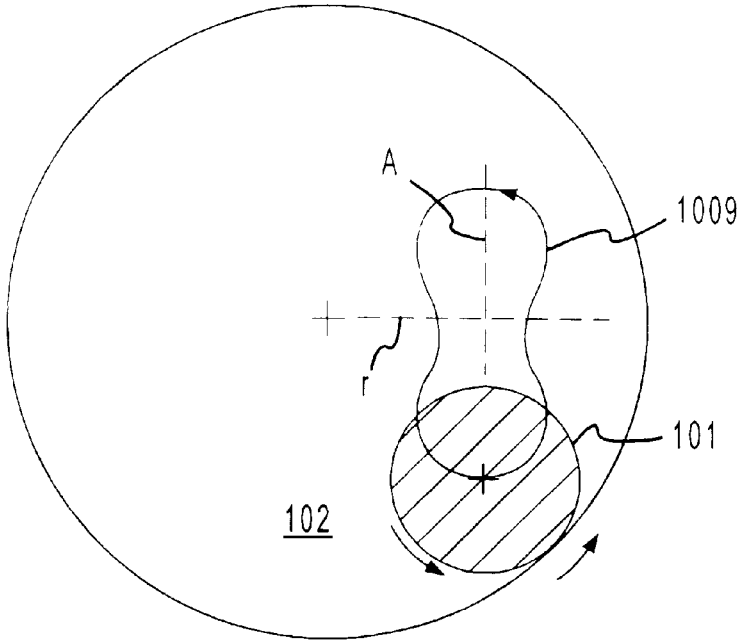
FIG. 10A is a top view of a polishing pad in a rotational CMP machine showing a peanut-shaped polishing pattern.

FIG. 10A is a top view of a polishing pad 102 in a rotational CMP machine, showing a peanut-shaped polishing pattern 1009. As shown in FIG. 10A, the long axis 'A' of peanut-shaped pattern 1009 is preferably substantially perpendicular to a radial line 'r' drawn from the center of polishing pad 102 through the center of axis 'A'. Axis 'A' is preferably offset from the center of pad 102 by a distance which maximizes the area of the pad which is swept by wafer 101 during a polishing (or planarizing) operation, while keeping the greater part of the wafer on the pad at all times. For an eight inch diameter wafer 101 on a polishing pad 102 having a diameter of 36 inches, the length and width of peanut shape 1009 are preferably 120 mm and 60 mm, respectively. In an exemplary embodiment, wafer 101 is moved across polishing pad 102 at a relative speed of 1,500 to 2,500 millimeters per minute for peanut pattern 1009 during the planarization process tracing five to eleven patterns per minute.

Figure 10B:
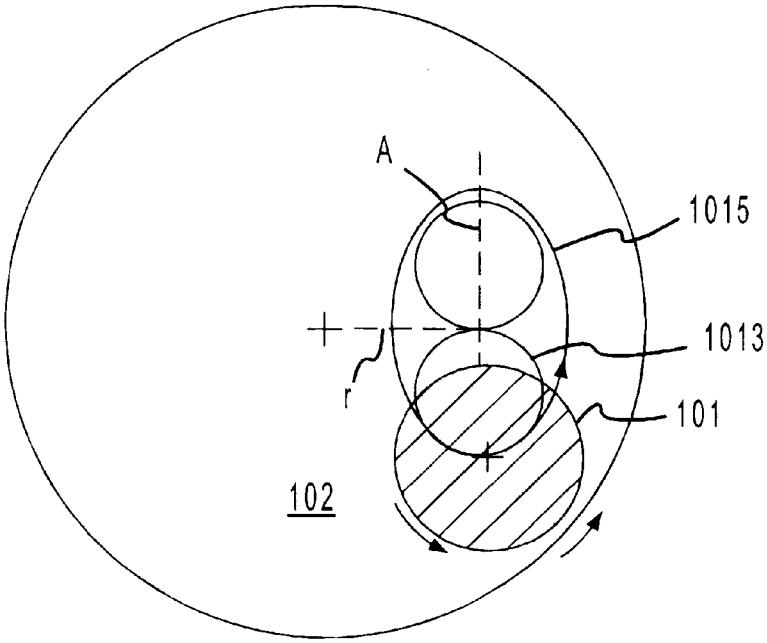
FIG. 10B is a top view of a polishing pad in a rotational CMP machine showing an elliptical polishing pattern.

FIG. 10B is a top view of a polishing pad 102 in a rotational CMP machine, showing a 'figure eight' pattern 1013 superimposed on an elliptical polishing pattern 1015. Both the elliptical pattern 1015 and the figure eight' pattern 1013 shown in FIG. 10B have a long axis 'A' which is preferably substantially perpendicular to a radial line 'r' drawn from the center of polishing pad 102 through the center of axis 'A'. Axis 'A' is preferably offset from the center of pad 102 by a distance which maximizes the area of the pad which is swept by wafer 101 during a polishing operation. This maximization of swept area is preferable for all of the polishing patterns described herein.

In the embodiment illustrated in FIG. 10B, wafer 101 is moved in an elliptical pattern 1015 relative to the polishing pad 102 during the first step of the planarization process. As shown in FIG. 10B, wafer 101 and polishing pad 102 are both rotated in the same direction (e.g., counterclockwise in FIG. 10B) as the direction travel of the wafer relative to the pad. The length of ellipse 1015 is preferably approximately twice that of its width, and, for an eight inch diameter wafer 101 on a polishing pad 102 having a diameter of 36 inches, the dimensions of ellipse 1015 are preferably 120 mm and 60 mm.

During the second step of the planarization process, wafer 101 is moved in a 'figure eight' pattern 1013 relative to the polishing pad 102. It should be noted that these steps may be performed in reverse order, i.e., the 'figure eight' pattern may be employed prior to the elliptical pattern, or the two patterns 1013 and 1015 may be alternately employed in any order.

In an exemplary embodiment, wafer 101 is moved across polishing pad 102 at a relative speed of 1,500 to 2,500 millimeters per minute for ellipse 1015 and 'figure eight' 1013 during the planarization process tracing five to eleven patterns per minute. The wafer 101 may be allowed to overhang the polishing pad 102 while tracing any part of one or more of the patterns described herein to improve the uniformity of pad edge wear, but preferably the wafer approaches, but does not overhang, the edge of the polishing pad.

Geometric Pattern Creation and Tracing

Figure 2:
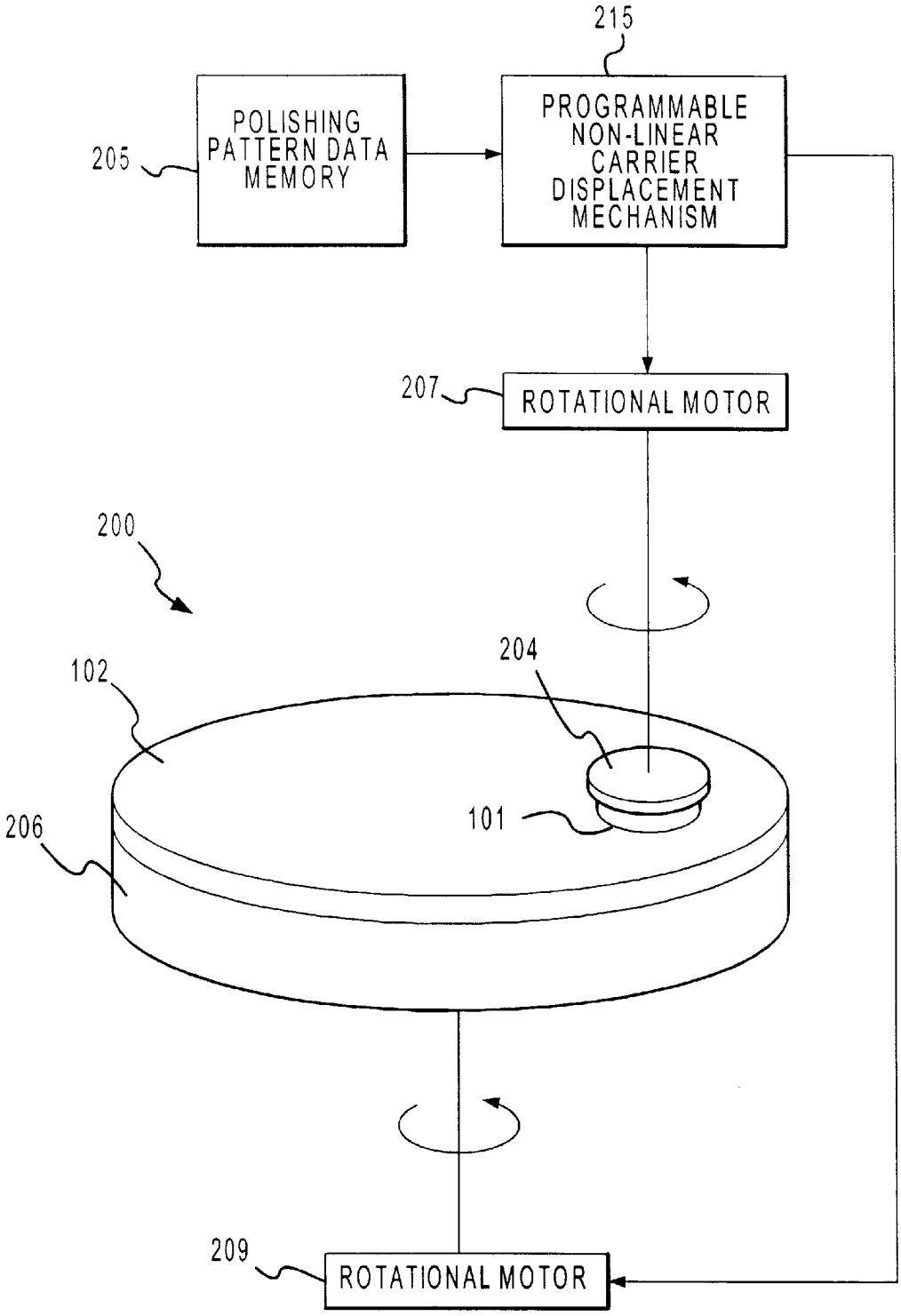
PRIOR ART FIG.2
FIG. 2 is a diagrammatic view of a prior art programmable rotational CMP machine.

FIG. 2 is a diagrammatic view of a prior art programmable CMP machine 200 capable of practicing the method of the present invention by moving a wafer 101 in various patterns relative to a polishing pad 102. A programmable CMP machine compatible with the present method is model no. SSP-136, manufactured by SpeedFam-IPEC of Phoenix, Ariz. As shown in FIG. 2, platen 206 and attached polishing pad 102 are rotated by motor 209, which is controlled by programmable carrier mechanism 215. Wafer 101 is rotated by motor 207, and moved relative to pad 102 by programmable carrier mechanism 215, which also controls motor 207. Software control (described below with reference to FIG. 11) is employed to define an x-y coordinate wafer carrier path over the polishing pad 102. Specifically, nonlinear carrier displacement mechanism 215 moves the wafer carrier head 204 and attached wafer 101 in a geometrical path defined by polishing pattern data, or 'code' stored in memory 205. A computer-driven controller located in programmable carrier mechanism 215 reads the polishing pattern data stored in memory 205 to control the movement of carrier head/wafer 204/101 to trace the geometric pattern or patterns in accordance with the x-y coordinates represented by the pattern data.

Bezier Splines

Bezier splines provide an efficient tool for calculating complex curves. By using a two dimensional Bezier spline, a complex curve can be described with only four points or coordinates. The Bezier Spline is defined over the interval [0,1] as:

$$c(t) = \sum_{i=0}^{n} b_i B_i^n(t), \quad t \in [0, 1]$$

where $b_i$ are the control points.

The interpolation functions used in the Bezier calculation are the Bernstein Polynomials defined for degree n as:

$$B_i^n(t) = \binom{n}{i} t^i (1-t)^{n+i}$$

where parameter t is in the range [0,1] and there are n+1 polynomials defined for each i from 0 to n.

The x and y coordinates of a point on curve c(t) can be rapidly calculated by a computer program using the following formula derived from the Bezier function:

$$x(t) = (1-t)(x_0 + 2tx_1 + 2tx_2) + tx_3 \quad (1)$$

$$y(t) = (1-t)(y_0 + 2ty_1 + 2ty_2) + ty_3 \quad (2)$$

for values of t ranging from 0 to 1; where $(x_0, y_0)$, $(x_3, y_3)$ are the anchor points and $(x_1, y_1)$, $(x_2, y_2)$ are the control points.

Figure 9:
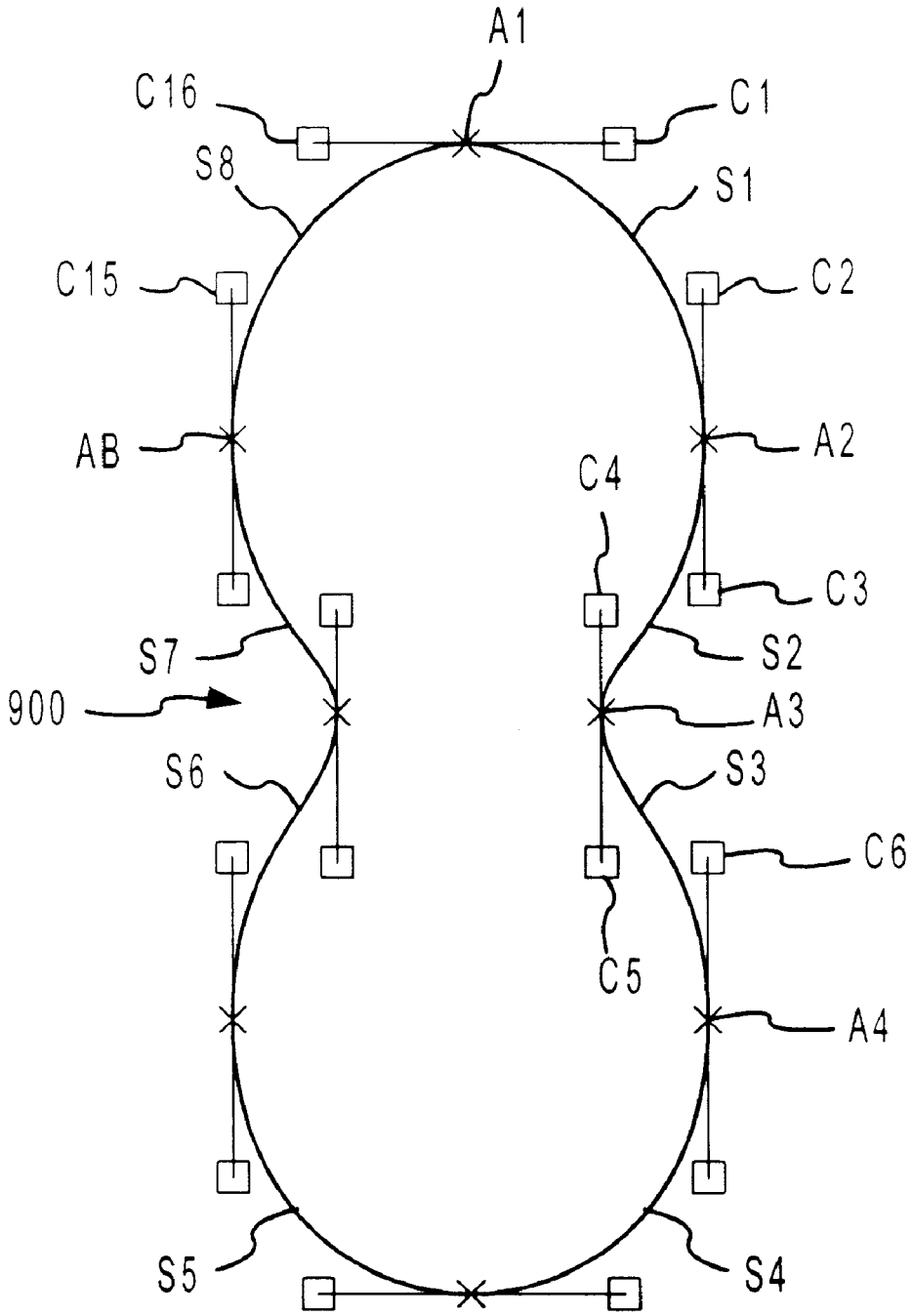
FIG. 9 is an illustration of a peanut-shaped pattern created from a series of Bezier splines.

FIG. 9 is an illustration of a peanut-shaped pattern 900 created from a series of Bezier splines. Two endpoints and two control points are the only data that needs to be stored in computer memory in order to generate the entire curve between the two endpoints. The two control points modify the curve by 'pulling' the curve away from a straight line toward the endpoints. As shown in FIG. 9, curve segment S1 of pattern 900 has control points C1 and C2, and endpoints A1 and A2 which function as anchor points. Curve segment S2 has control points C3 and C4, and anchor points (and endpoints) A2 and A3. Since segments S1 and S2 share a common endpoint, A2, the segments are contiguous, thus forming a continuous curve. Segments S3 through S8 are created in a similar manner to form the peanut-shaped pattern 900. Bezier splines can be used to simplify the generation of other geometric patterns employed by the present invention, including elliptical patterns in particular.

An advantage of using Bezier splines to generate geometric patterns lies in the fact that any desired geometric pattern may be generated from a set of very few data points—specifically, four coordinates per curve segment or spline.

Figure 11:
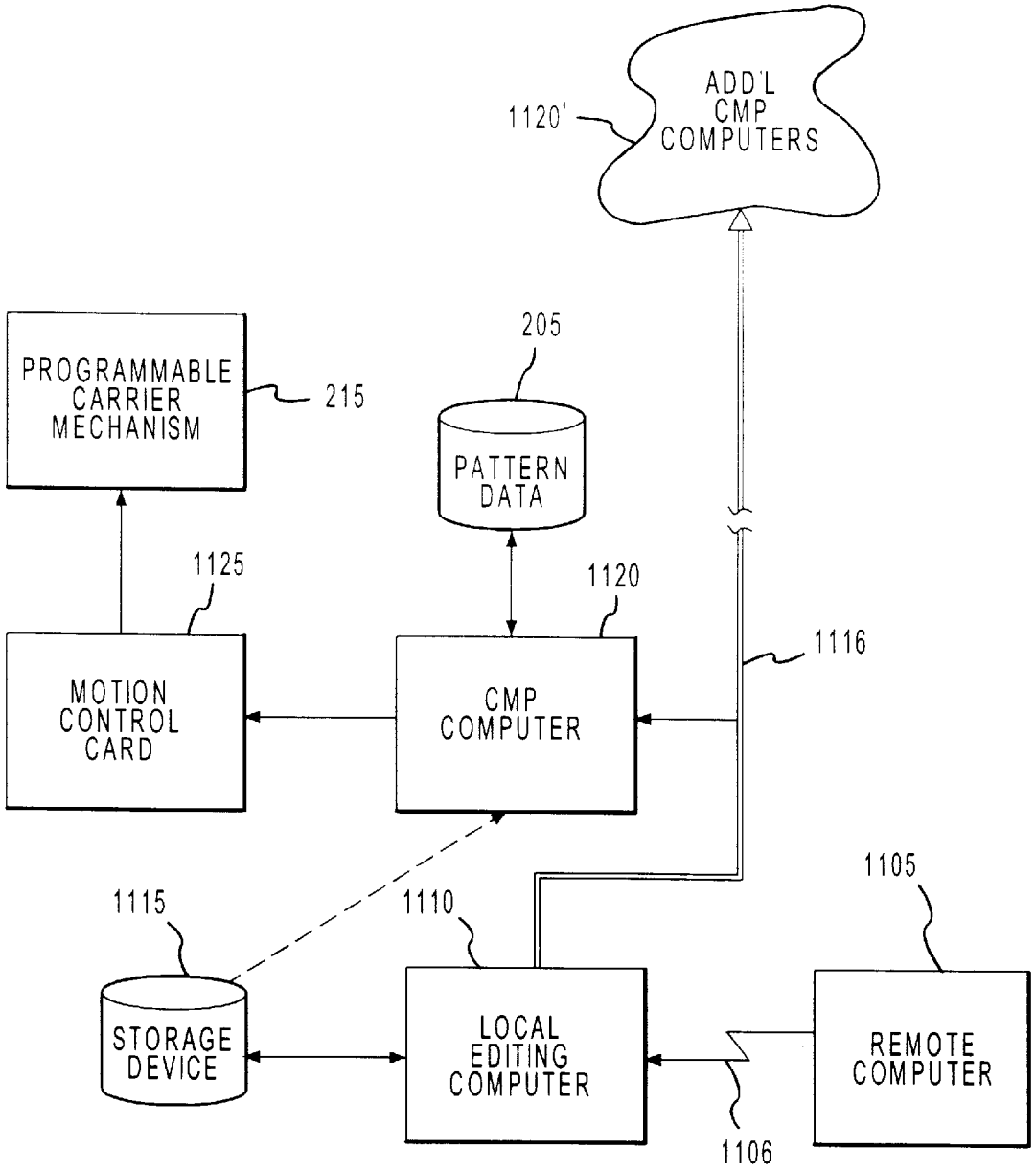
FIG. 11 is a diagram showing the interconnection between the devices used in editing Bezier splines and transferring the spline data to one or more CMP machines.

FIG. 11 is a diagram showing the interconnection between the devices used in creating Bezier splines and transferring the spline data (i.e., the coordinates for each spline) to one or more CMP machines. With reference to FIG. 11, the coordinates for a geometric polishing pattern, such as peanut-shaped pattern 900, are first generated using Bezier splines according to the method described with reference to FIG. 9. The desired geometric pattern coordinate data is generated on either local editing computer 1110 or remote computer 1105 using a Bezier curve editing program such as is known in the art. If a remote computer 1105 is used to generate the polishing pattern data, the data may be transferred to local editing computer 1110 via an Internet link or other communication means. After a particular polishing pattern is generated and edited, the resultant pattern data is stored on a storage device 1115, which may be a fixed disk drive, or a portable storage device such as a flexible ('floppy') disk, or any other suitable data storage means.

After data for a particular curve, or pattern, has been generated by computer 1105 or 1110, the four coordinates calculated for each spline (curve segment) are transferred to CMP computer 1120 polishing pattern data memory 205. This coordinate data may be transferred via communication link 1116, or, alternatively, the data may be physically transferred to CMP computer 1120 and loaded into memory 205 by use of a portable data storage device 1115 such as a flexible disk, or the like. Communication link 1116 may be a local area network, such as an ethernet link, in which case additional CMP computers 1120 may also be simultaneously downloaded with the polishing pattern data. The small amount of data generated for each spline enables the data to be rapidly transferred between remote computer 1105 and local computer 1100, as well as between local computer 1110 and CMP computers 1120/1120. CMP computer 1120 uses the Bezier coordinate data stored in polishing pattern data memory 205 to calculate the x-y coordinate points required by programmable carrier mechanism 215. Alternatively, motion control card 1125 (located in programmable CMP machine 200) calculates the x-y coordinate points, if the motion control card has an integral processor programmed to make the calculations. In either case, the motor control x-y coordinates are calculated by using Bezier function equations (1) and (2), above. Motion control card 1125 then translates the calculated x-y coordinates into the desired geometric pattern to drive programmable carrier mechanism 215 accordingly.

Although the foregoing description sets forth exemplary embodiments of the invention, the scope of the invention is not limited to these specific embodiments. Modification may be made to the specific form and design of the invention without departing from its spirit and scope as expressed in the following claims.

What is claimed is:

1. A method for planarizing a surface of a wafer against a polishing pad, wherein the wafer is secured in a carrier and pressed against the pad, comprising the steps of:

generating a set of data points representing a peanut-shaped pattern using a plurality of Bezier splines; and effecting a relative movement between the wafer and the polishing pad to create a peanut-shaped pattern using the set of data points.

2. The method of claim 1, wherein said data points represent x-y coordinates on the polishing pad, and the carrier traces said x-y points on the pad during a planarization process.

3. A method for planarizing a surface of a wafer against a polishing pad, wherein the wafer is secured in a carrier and pressed against the pad, comprising the steps of:

generating a set of data points representing a geometric pattern using a plurality of Bezier splines; and effecting a relative movement between the wafer and the polishing pad to create said geometric pattern therebetween using the set of data points.

4. The method of claim 3, wherein said data points represent x-y coordinates on the polishing pad, and the carrier traces said x-y points on the pad during a planarization process.

5. The method of claim 3, wherein said geometric pattern is a peanut-shaped pattern.

6. The method of claim 3, wherein said geometric pattern is an elliptical pattern.

7. The method of claim 3, wherein said geometric pattern is a figure-eight pattern.

8. A method for planarizing a surface of a wafer against a polishing pad, wherein the wafer is secured in a carrier and pressed against the pad, comprising the steps of:

generating a first set of data points representing a first geometric pattern using a plurality of Bezier splines;

generating a second set of data points representing a second geometric pattern using a plurality of Bezier splines;

effecting a relative movement between the wafer and the polishing pad to create said first geometric pattern therebetween using the first set of data points; and effecting a relative movement between the wafer and polishing pad to create said second geometric pattern therebetween using the second set of data points.

9. The method of claim 8, wherein said data points represent x-y coordinates on the polishing pad, and the carrier traces said x-y points on the pad during a planarization process.

10. The method of claim 8, wherein the steps of effecting a relative movement between the wafer and the polishing pad are performed in any order.

11. The method of claim 10, wherein said first geometric pattern is an elliptical pattern and said second geometric pattern is a figure-eight pattern.

* * * * *